US007849805B2

(12) United States Patent
Brüggemann et al.

(10) Patent No.: US 7,849,805 B2
(45) Date of Patent: Dec. 14, 2010

(54) SYSTEM AND METHOD FOR THE OPERATION OF A FURNACE THAT IS OPERATED WITH AT LEAST ONE COAL PULVERIZER

(75) Inventors: Hellmuth Brüggemann, Esslingen (DE); Frank Rauch, Allmersbach (DE); Hasthika Weerasinghe, Ludwigsburg (DE)

(73) Assignee: ALSTOM Technology Ltd., Baden (DE)

( * ) Notice: Subject to any disclaimer, the term of this patent is extended or adjusted under 35 U.S.C. 154(b) by 409 days.

(21) Appl. No.: 12/012,559

(22) Filed: Feb. 4, 2008

(65) Prior Publication Data

US 2008/0190337 A1 Aug. 14, 2008

(30) Foreign Application Priority Data

Feb. 13, 2007 (DE) ..... 10 2007 007 603

(51) Int. Cl.

| | |
|---|---|
| ***F23L 13/00*** | (2006.01) |
| ***F23N 3/02*** | (2006.01) |
| ***F23D 1/00*** | (2006.01) |
| ***F23K 1/00*** | (2006.01) |
| *F23N 3/00* | (2006.01) |

(52) U.S. Cl. ..... 110/163; 110/347; 110/186; 110/191; 110/232; 110/263

(58) Field of Classification Search ..... 110/106, 110/232, 347, 261, 186, 191, 263, 163; 137/601.17, 137/312; 251/305

See application file for complete search history.

(56) References Cited

PUBLICATIONS

NFPA 8503, Standard for Pulverized Fuel System, pp. 1-40, Quincy, MA, 1997 Edition.

*Primary Examiner*—Kenneth B Rinehart
*Assistant Examiner*—David J Laux
(74) *Attorney, Agent, or Firm*—Alix, Yale & Ristas, LLP

(57) ABSTRACT

A primary air system for a combustion plant provides a flow of primary air to at least one coal pulverizer, which emits pulverized coal in a downstream direction to a furnace. The primary air system includes a first primary air line for feeding hot primary air to the coal pulverizer and a second primary air line for admixing of cold primary air into the hot primary air line at a mixing location positioned upstream of the coal pulverizer. A control system shuts off the flow of primary air to the coal pulverizer, when the coal pulverizer is being repaired or serviced while the furnace is in operation. The control system includes a first flow control butterfly valve disposed in the first primary air line at a position upstream of the mixing location and a second flow control butterfly valve disposed in the second primary air line at a position upstream of the mixing location. A shut-off butterfly valve, disposed in the primary air line intermediate the mixing location and the coal pulverizer, includes a tandem wing supported at a cental location and movable between an open position and a closed position. The tandem wing has parallel, first and second wings forming a space therebetween. A pressure relief line provides fluid communication with the space between the first and second wings when the tandem wing is in the closed position. A pressure relief butterfly valve is disposed in the pressure relief line.

10 Claims, 5 Drawing Sheets

SYSTEM AND METHOD FOR THE OPERATION OF A FURNACE THAT IS OPERATED WITH AT LEAST ONE COAL PULVERIZER

BACKGROUND

This disclosure relates to a system and a method for the operation of a furnace that is operated with at least one coal pulverizer.

Systems and methods for the operation of a furnace that is operated with at least one coal pulverizer are known. Thus, for example, in the document "Kraftwerkstechnik zur Nutzung fossiler, regenerativer und nuklearer Energiequellen" ["Power plant engineering for utilization of fossil, regenerative and nuclear energy sources"] by Karl Strauss, Springer Verlag, 1994, a system and a method of this type are shown. In Chapter "4.3.2.2 Staubfeuerungen" ["Coal Dust Firings"] from the document mentioned above, the detailed mode of operation of a furnace with at least one coal pulverizer can be found, whereby the block diagram that is shown illustrates a coal pulverizer with the associated incoming and outgoing lines of primary air, raw coal, coal dust, etc. According to this, the coal needed for firing in the furnace is pulverized into coal dust and dried in at least one coal pulverizer. To dry the coal inside the mill, as well as for the combustion of the coal dust in the furnace, preheated air, i.e., primary air, is supplied that is generated through the exchange of heat in an air preheater ("Luvo") of the fresh air that is being drawn in with the hot exhaust gas, i.e., flue gas, from the combustion of the coal in the furnace. In that regard, the majority of the fresh air that is drawn in is directed through the air preheater and thereby heated, and the remaining portion of fresh air that is drawn in is diverted upstream of the air preheater and is mixed unheated, i.e., as cold air, back into the heated portion of the fresh or primary air downstream of the air preheater. To ensure that the coal pulverizer is charged with primary air of a certain temperature range, the primary air temperature can be adjusted by admixing a certain amount of cold primary air into the hot primary air by appropriately adjusting the flow control butterfly valves in the incoming lines of the heated and cold primary air. The heated, i.e., hot primary air which, as already mentioned above, is utilized for drying the pulverized coal dust, functions within the mill, i.e., coal pulverizer, and downstream of the mill to the coal dust burners of the furnace, as carrier air as well, since it entrains or carries the coal dust particles in suspension.

Since operation with coal dust inside a furnace or coal dust furnace holds certain dangers, the regulations TRD 413 (Technical Regulations for Steam Boilers) and European Standard EN 12952, Part 9, provide for specific safety measures. They can be found, for example, in the document "Explosionsschutzmassnahmen für Kohlenstaubfeuerungen in Kraftwerken" ["Explosion Protection Measures for Coal Dust Firings in Power Plants"] by F. Arens-Fischer, VGB Kraftwerkstechnik [Technical Association of Large Power Plant Operators, Power Plant Engineering] 72 (1992), Number 6. There, in FIG. 1 and its associated description, it is explained that certain requirements of TRD 413 lead to the installation of safety quick-acting butterfly valves in the carrier air lines, i.e., the mill (primary) air lines. Within a safe period of time, these safety quick-acting butterfly valves interrupt the feeding of coal dust into the combustion chamber, since they cut off the feeding of carrier or primary air to the mill, and thus no more air that could carry coal dust flows through the coal pulverizer in the direction of the coal dust burners, i.e., the combustion chamber. Usually, these safety quick-acting butterfly valves or safety butterfly valves are designed as swiveling butterfly valves that are opened by means of pneumatic, hydraulic or electric actuators and closed by means of springs or weights (the so-called safety position). Lamellar seals are usually used to keep the leakage of the safety quick-acting butterfly valves low, and the safety butterfly valves are located in channel pockets in order to prevent wear on their wings.

TRD 413 further provides that for repair and servicing purposes, shut-off arrangements be provided ahead of and behind the coal pulverizer if work is to be done on the coal pulverizer during operation of the coal dust furnace or the boiler plant. For shut-off ahead of the coal pulverizer, i.e., upstream of the coal pulverizer when seen in the direction of flow of the primary air, the existing quick-acting or safety butterfly valve is used as the shut-off valve in order to avoid having to install a second butterfly valve ahead of the coal pulverizer. However, it has been shown that by doing this, despite the high-quality, expensive sealing system in the safety butterfly valve, hot primary air in the form of leakage air gets past the safety butterfly valve and flows into the coal pulverizer. As a result of the flow of hot primary air into the coal pulverizer, however, it is not safe to perform repair or servicing work inside the coal pulverizer. To remedy this, large covers on the primary air line of doors on the coal pulverizer have to be opened in order to keep temperatures inside the coal pulverizer tolerable for the repair personnel or servicing personnel. This requires an additional, time-consuming installation effort, whereby the working conditions inside the coal pulverizer are sometimes not significantly improved.

In the design of the latest generation of power plants (>800 MW of electricity), new coal pulverizers with very large dimensions are required for the furnaces, i.e., coal dust furnaces, of the power plants, which of necessity require primary air lines and safety or shut-off butterfly valves with larger dimensions. It has been shown in that regard that the own weight of the enlarged construction of the safety butterfly valve designed as a swiveling butterfly valve increases not linearly, but progressively. The same holds true for the increase of the torque required for actuating the swiveling butterfly valve by the pneumatic, hydraulic or electrical actuator, since when the swiveling butterfly valve is opened, the counterpressure resulting from the primary air present at the swiveling butterfly valve has to be overcome. Because of its increased area, an enlarged swiveling butterfly valve thus results in greater counterpressure from the primary air, thus substantially increasing torque required for actuating the swiveling butterfly valve. Compared with the safety butterfly valves that have been common and in use up to now, disproportionally growing costs are required for the production or acquisition of the safety butterfly valve and for the required components, particularly the actuating drive for the safety butterfly valve.

In contrast to the regulations TRD 413 and EN 12952, Part 9, the American regulation NFPA 8503, Standard for Pulverized Fuel Systems, provides that the quick-acting butterfly valve required for emergency situations to shut off the flow of primary or carrier air flow is not arranged upstream of the coal pulverizer, but downstream of the coal pulverizer instead. In the event of necessary repair or servicing on a coal pulverizer, this regulation provides butterfly shut-off valves upstream of the coal pulverizer. However, it has been shown that depending on the design of the shut-off butterfly valves, they are more or less leakproof, and therefore leakage air can flow through the shut-off butterfly valves and continue on into the coal pulverizer. Safe servicing or repairs inside the coal pulverizer is then no longer assured.

SUMMARY

The task is to create a system for the operation of a furnace that is operated with at least one coal pulverizer that avoids the disadvantages mentioned above. In particular, it is the task of the disclosure to create a system for the operation of a furnace that is operated with at least one coal pulverizer that exhibits a cost-effective shut-off butterfly valve upstream of the coal pulverizer when seen in the direction of flow of the primary air, and that prevents the penetration of hot primary air into the coal pulverizer and thus allows safe repair and servicing work inside the coal pulverizer during ongoing operation of the furnace. It is also the task of the disclosure to suggest a method for the operation of a furnace that is operated with at least one coal pulverizer.

Through the disclosed solution, a system and a method for the operation of a furnace that is operated with at least one coal pulverizer is created, which exhibits the following advantages:

- Shut-off butterfly valve inside the primary air line upstream of the coal pulverizer, with a centrally supported tandem butterfly valve, the resulting simplified execution of the shut-off butterfly valve and a lower torque requirement for actuating the butterfly valve; this allows the use of smaller butterfly valve actuating drives, and thus utilization of less expensive actuator components,
- Prevention of leakage of primary air at the shut-off butterfly valve in the direction of the coal pulverizer through controlled diversion of the leakage air into the atmosphere through a pressure relief line,
- Safe servicing and repair inside the coal pulverizer that has been blocked off by the shut-off butterfly valve during operation of the furnace,
- The previous butterfly valve concept with shut-off butterfly valve and safety butterfly valve and the two flow control butterfly valves in the cold and hot primary air lines undergoes improved utilization.

An advantageous design of the disclosure provides that the actuation of the shut-off butterfly valve and that of the pressure relief butterfly valve are mechanically coupled with each other by means of a butterfly valve actuating arrangement. This means that in a simple way it is possible to ensure that when the shut-off butterfly valve is actuated, the actuation of the pressure relief butterfly valve occurs simultaneously. A second actuating drive for the pressure relief butterfly valve, along with the expensive process control engineering for the control of this second actuating drive, can be eliminated.

In an advantageous development of the disclosure, the sealing strips of the shut-off butterfly valve are arranged either on the tandem wing or on the housing of the shut-off butterfly valve. The design of the sealing strips can thus be optimally adapted to the particular realities of the shut-off butterfly valve design.

In an advantageous design of the disclosure, the sealing strips of the first flow control butterfly valve are arranged either on the butterfly valve wing or on the housing of the first flow control butterfly valve. The design of the sealing strips, as before, can thus also be optimally adapted to the particular realities of the first flow control butterfly valve.

A further advantageous design provides that the coal dust line that is arranged downstream of the coal pulverizer when seen in the direction of flow of the primary air and is connected with the coal pulverizer is equipped with a shut-off arrangement. As a result, when the shut-off arrangement in the coal dust line is closed, a backflow of flue gases from the combustion chamber through the coal dust line in the direction of the coal pulverizer can be prevented.

In an advantageous development of the disclosure, the shut-off butterfly valve is designed as a safety quick-acting butterfly valve. Through this measure, two functions can be performed by one butterfly valve, first, the shut-off for the repair and/or servicing inside the coal pulverizer, and second, the quick-acting function for emergency situations. For that purpose, the shut-off butterfly valve is designed with suitable springs or counterweights that close the butterfly shut-off valve very quickly in case of emergency. In addition, the actuating drive of the shut-off butterfly valve is linked on the control side in such a way that it opens the butterfly valve or holds it open during operations, and interrupts the open state in case of emergency, and the springs or counterweights can then act upon the shut-off butterfly valve to close it.

A further advantageous design of the disclosure provides that the coal dust line that is arranged downstream of the coal pulverizer when seen in the direction of flow of the primary air and is connected with the coal pulverizer is equipped with a quick-acting slide valve in order to interrupt the coal dust flow from the coal pulverizer in the direction of the coal dust burners in the shortest possible time in case of emergency.

The second flow control butterfly valve is advantageously opened only when the shut-off butterfly valve is in the closed position. This prevents a greater primary air flow from reaching the coal pulverizer before the shut-off butterfly valve is closed.

BRIEF DESCRIPTION OF THE DRAWINGS

The present disclosure may be better understood and its numerous objects and advantages will become apparent to those skilled in the art by reference to the accompanying drawings in which.

DETAILED DESCRIPTION

Figure 1:
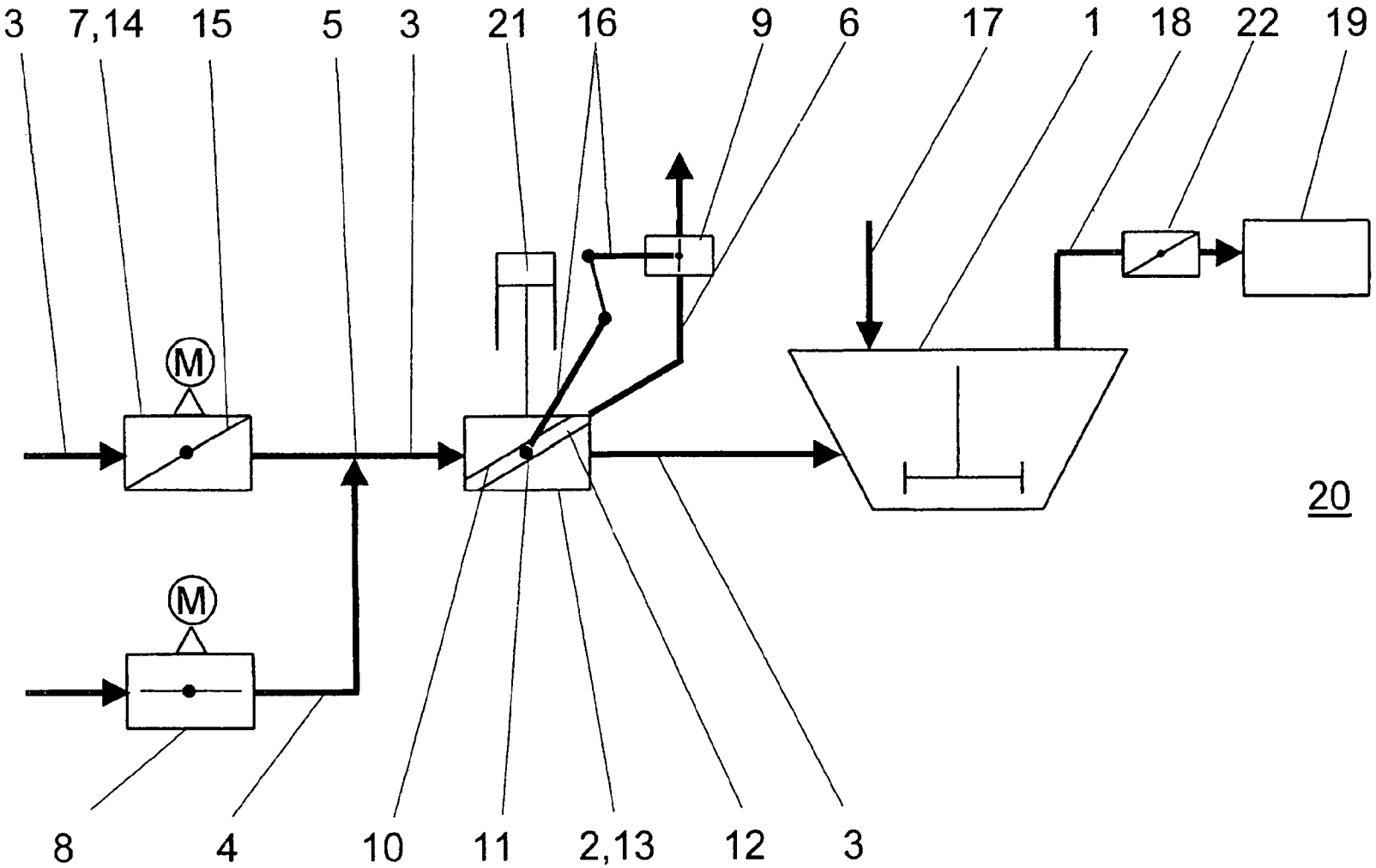
FIG. 1 is a schematic drawing of a system for shutting off the primary air line upstream of a coal pulverizer of a furnace operated with at least one coal pulverizer, whereby the safety quick-actihg butterfly valve is arranged upstream of the coal pulverizer when seen in the direction of flow of the primary air.

FIG. 1 shows a schematic representation of the system, whereby the representation is essentially limited to a coal pulverizer 1 with its associated incoming and outgoing lines 3, 4, 17, 18 of a furnace 20 that is not shown in detail. The furnace 20 can be part of a power plant, not shown, for generating electricity, for example, and exhibits at least one, in most cases two to four coal pulverizers 1, which are normally all in operation. During operation, unpulverized coal is fed to the coal pulverizer 1 through a coal feed line 17, the coal is comminuted in the coal pulverizer 1, and in conjunction with that, is largely dried by means of hot primary air that is introduced through the first primary air line 3. The coal dust is fed by the hot primary air, which simultaneously acts as carrier air, through a coal dust line 18 to the coal dust burner(s) 19, by means of which the coal dust is burned in the presence of the primary air and additionally fed secondary air (not shown) in a combustion chamber, not shown in detail, of the furnace 20.

To maintain a specific temperature range inside the coal pulverizer 1, the feed lines of the hot and cold primary air, i.e., the first and second primary air lines 3, 4, exhibit flow-control butterfly valves 7 and 8. At the mixing location 5, which when seen from the direction of flow of the primary air is downstream of the flow control butterfly valves 7, 8 and upstream of the coal pulverizer 1, the cold primary air is mixed into the hot primary air. This means that the second primary air line 4 that carries the cold primary air discharges into the first primary air line 3 that carries the hot primary air at the mixing location 5. In the direction of flow of the primary air, the system exhibits between the mixing location 5 and the coal pulverizer 1 a shut-off butterfly valve 2, which shuts off the flow of the primary or carrier air in the direction of the coal pulverizer 1 in the event repairs or servicing becomes necessary on or inside the coal pulverizer 1, and thus cuts off the coal dust flow to the coal dust burner 19, since without the carrier air, coal dust particles can no longer reach the coal dust burner 19.

The inventive system for shutting off the primary air line 3 upstream of a coal pulverizer 1, which, when compared with the system according to the state of the art, allows no primary air leakage within the shut-off butterfly valve 2 in the direction of the coal pulverizer 1, exhibits a shut-off butterfly valve 2 that is equipped with a centrally supported tandem wing 10 and a pressure relief line 6 that is connected with the outside atmosphere and exhibits a pressure relief butterfly valve 9. In addition, both the shut-off butterfly valve 2 and the first flow control butterfly valve 7 exhibit sealing strips 13, 14. They can be mounted either directly on the tandem or butterfly valve wing 10, 15 or on the butterfly valve housing of the butterfly valves 2, 7.

The two wings of the tandem wing 10, which are at a distance from each other, form a hollow space 12 between the wings. The pressure relief line 6 is arranged on the shut-off butterfly valve 2 in such a way that when the shut-off butterfly valve 2 and the tandem wing 10 are in the closed state, the line 6 is connected with the latter's hollow space 12, i.e., communicates with it, and thus leakage primary air that is present in the hollow space 12 can escape into the atmosphere through the pressure relief line 6 and the opened pressure relief butterfly valve 9. The pressure relief butterfly valve 9 of the line 6 is preferably coupled with shut-off butterfly valve 2 by means of a mechanical butterfly valve actuating arrangement 16. The coupling of the two butterfly valves 2, 9 is designed so that when shut-off butterfly valve 2, i.e., the tandem wing 10, is closed, the pressure relief butterfly valve 9 is opened, and when the shut-off butterfly valve 2 is opened, the pressure relief butterfly valve 9 is closed. Instead of the mechanical butterfly valve actuating arrangement 16, the pressure relief butterfly valve 9 can also be actuated by means of its own pneumatic, hydraulic or electric drive, not shown. When its own drive is used for the pressure relief butterfly valve 9, it must be assured that, as described above, the butterfly valve 9 is opened when the shut-off butterfly valve 2 is closed, and vice versa. This can be accomplished by means of automatic control and process control equipment, for example.

Due to the centrally arranged shaft 11 of the tandem wing 10, substantially less torque is required to actuate the tandem wing 10 compared with a swiveling butterfly valve that is supported eccentrically or on one side, since the entire butterfly valve surface pressure caused by the primary air that is present does not have to be overcome when the tandem wing 10 is opened by the actuating drive 21. Accompanying that is the use of a significantly smaller and less expensive actuating drive 21, which can be powered pneumatically, hydraulically or electrically. What is meant by a centrally arranged shaft 11 is that when seen over the length of the tandem wing 10, the actuating shaft 11 is arranged in the center of the tandem wing 10, whereby the shaft 11 can lie inside the two wings of the tandem wing 10, i.e., in the hollow space 12, or outside the two wings.

During normal operation of the furnace 20, the shut-off butterfly valves 2 of all of the coal pulverizers that are in operation are open and the two flow control butterfly valves 7, 8 of the particular coal pulverizer 1 are adjusted in such a way, by means of commercially available control drives, not shown, that the coal pulverizer 1 is charged with a mixture of hot and cold primary air having a temperature within a predetermined range. In the event repair or servicing is required on one of the coal pulverizers 1 of the furnace 20 with the furnace 20 remaining in operation, as the first step of the procedure the shut-off butterfly valve 2 upstream of the coal pulverizer to be repaired or serviced is closed and simultaneously the pressure relief butterfly valve 9 inside the pressure relief line 6 is opened. As the next step of the procedure, the first flow control butterfly valve 7 is closed so the feeding of hot primary air to the coal pulverizer 1 is cut off. The second flow control valve 8 is then opened so cold primary air goes through the second primary air line 4 and through the mixing site 5 into the first primary air line 3, in which the cold primary air rests against the closed butterfly valves 2 and 7 as sealing air. Since the cold primary air exhibits a slightly higher pressure than the hot primary air (pressure losses as a result of passing through the air preheater), the cold primary air can reliably seal off the hot primary air at the first flow control butterfly valve 7, since any leakage of the hot primary air that might occur at this flow control valve 7 is prevented by the higher counterpressure of the cold primary air. At the shut-off butterfly valve 2, leakage in the direction of the coal pulverizer 1 by the cold primary air that is being used as sealing air is prevented in this respect, since cold primary air that passes through the first wing of the tandem wing 10 and is inside the hollow space 12 is collected between the two wings of the tandem wing 10 and is diverted into the atmosphere through the pressure relief line 6 that is connected with the hollow space 12. Leakage of the cold primary air in the direction of the coal pulverizer 1 is thus prevented, and safe servicing or repair work inside the coal pulverizer 1 is made possible.

The shut-off butterfly valve 2 can be designed as a safety quick-acting butterfly valve as in FIG. 1 in order to comply, for example, with the regulations of TRD 413 or EN 12952, Part 9. In emergency situations, the primary air flow inside the primary air line 3 in the direction of the coal pulverizer 1 is then shut off in the shortest possible time, in that the tandem wing 10 is brought by means of spring force or counterweights into the closed position in the shortest possible time or within a safety period of time, and thus the flow of coal dust to the coal dust burner 19 is cut off. After the emergency situation, the safety quick-acting butterfly valve can be brought back into the open position by the actuating drive 21.

In order to achieve the quick action, the shut-off butterfly valve 2 is equipped with suitable springs or counterweights, and the actuating drive 21 is appropriately wired for automatic control so that it switches out of its open position in case of emergency. As a result of the combination, simultaneously designing the shut-off butterfly valve 2 as a safety quick-acting butterfly valve, the arranging of a second butterfly valve is no longer necessary. The system is less expensive overall.

As a further step of the procedure and as an additional safeguard for repair and servicing work on the coal pulverizer 1, the shut-off arrangement 22 that is arranged in the coal dust line 18 between the coal pulverizer 1 and the coal dust burner 19 can be closed. When the shut-off arrangement 22 is closed, it prevents possible combustion chamber gases from the combustion chamber of the furnace 20, which is in operation, from flowing backwards through the coal dust line 18 in the direction of the coal pulverizer 1.

Any repair or servicing that becomes necessary on a shut-off coal pulverizer 1 takes place while the furnace 20 is in operation, i.e., while other coal pulverizers 1 of the furnace 20 are in operation, or if only one coal pulverizer 1 is present, while the oil or gas auxiliary burner is in operation. FIG. 1 illustrates schematically the state of the system as it appears relative to the butterfly valve positions of butterfly valves 2, 7, 8, 9, 22 during repair or servicing.

Figure 2:
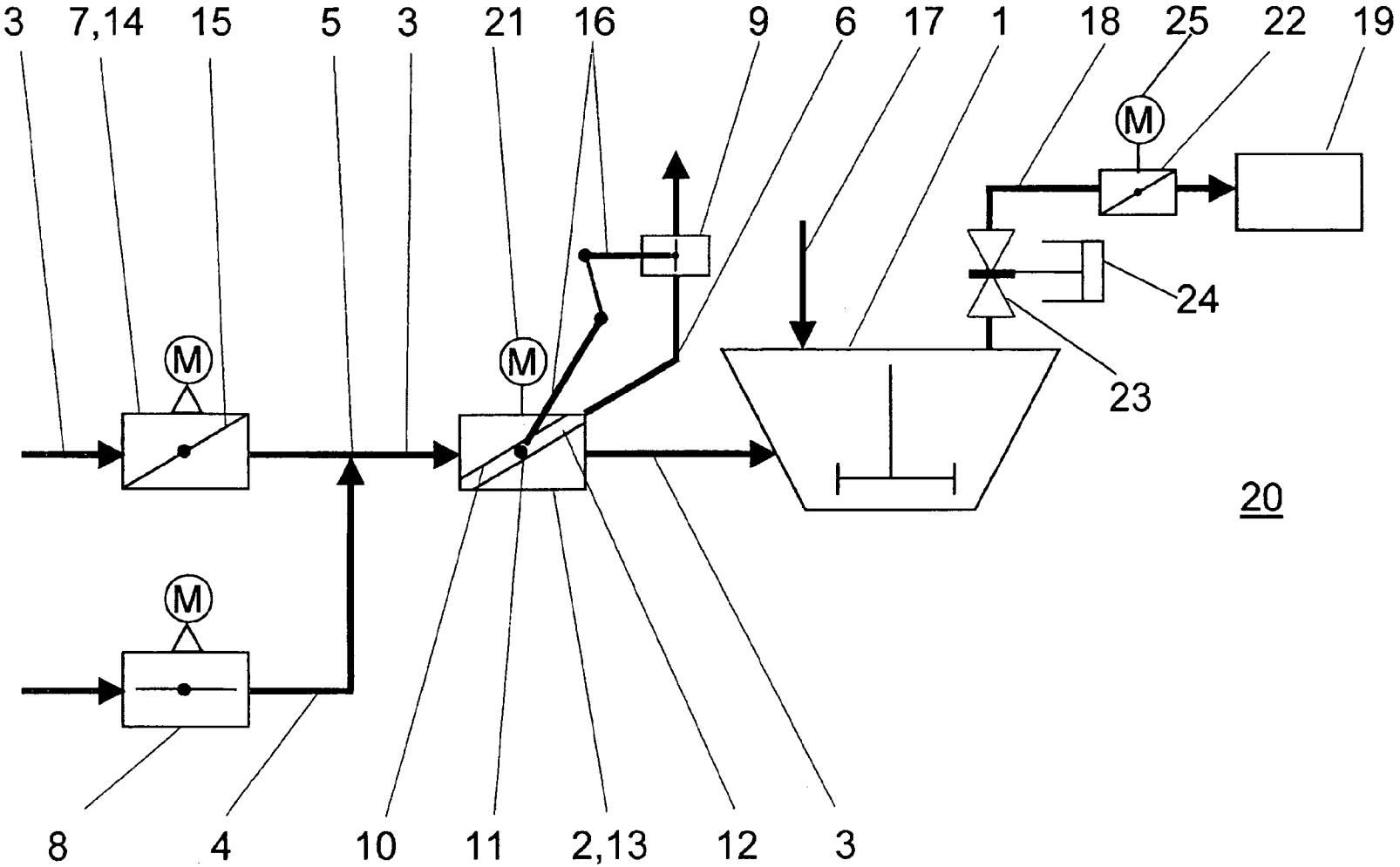
FIG. 2 is a schematic drawing of a system for shutting off the primary air line upstream of a coal pulverizer of a furnace operated with at least one coal pulverizer, whereby the safety quick-acting butterfly valve is arranged downstream of the coal pulverizer when seen in the direction of flow of the primary air.
Figure 3:
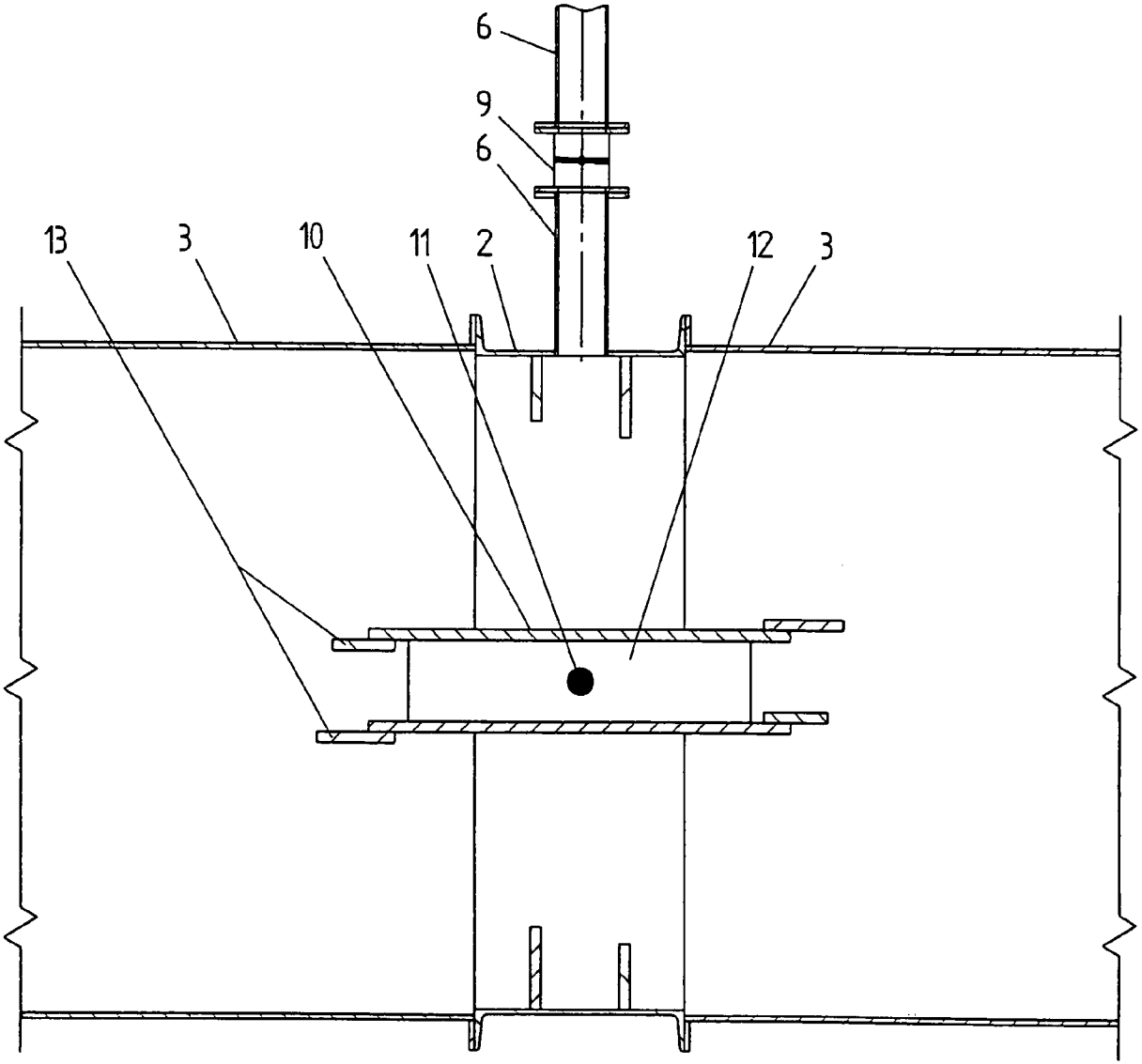
FIG. 3 is an enlarged schematic view of the shut-off butterfly valve of FIG. 1 in the open position, illustrating the sealing strip interacting with the butterfly valve.
Figure 4:
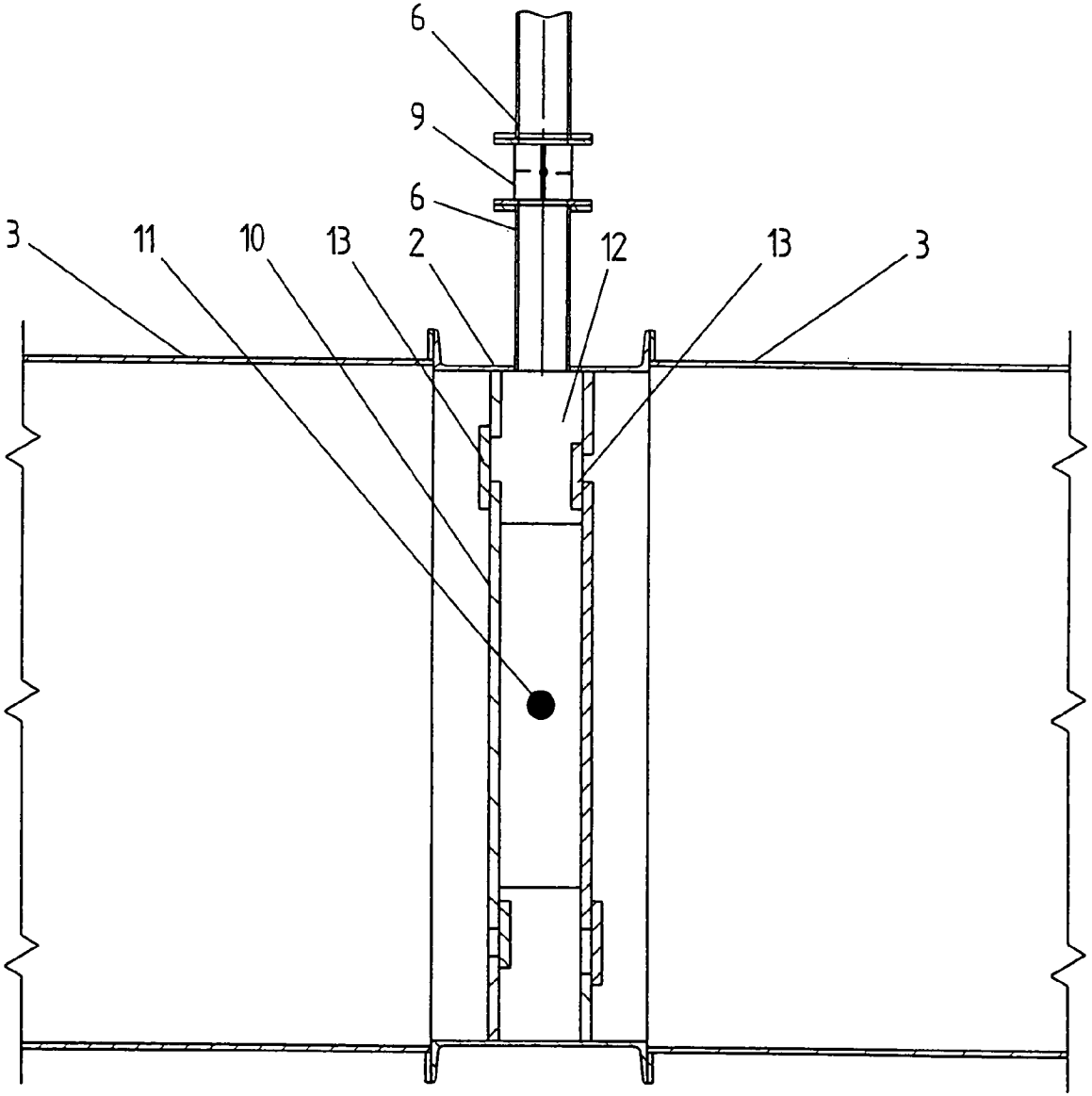
FIG. 4 is an enlarged schematic view of the shut-off butterfly valve of FIG. 1 in the closed position, illustrating the sealing strip interacting with the butterfly valve.
Figure 5:
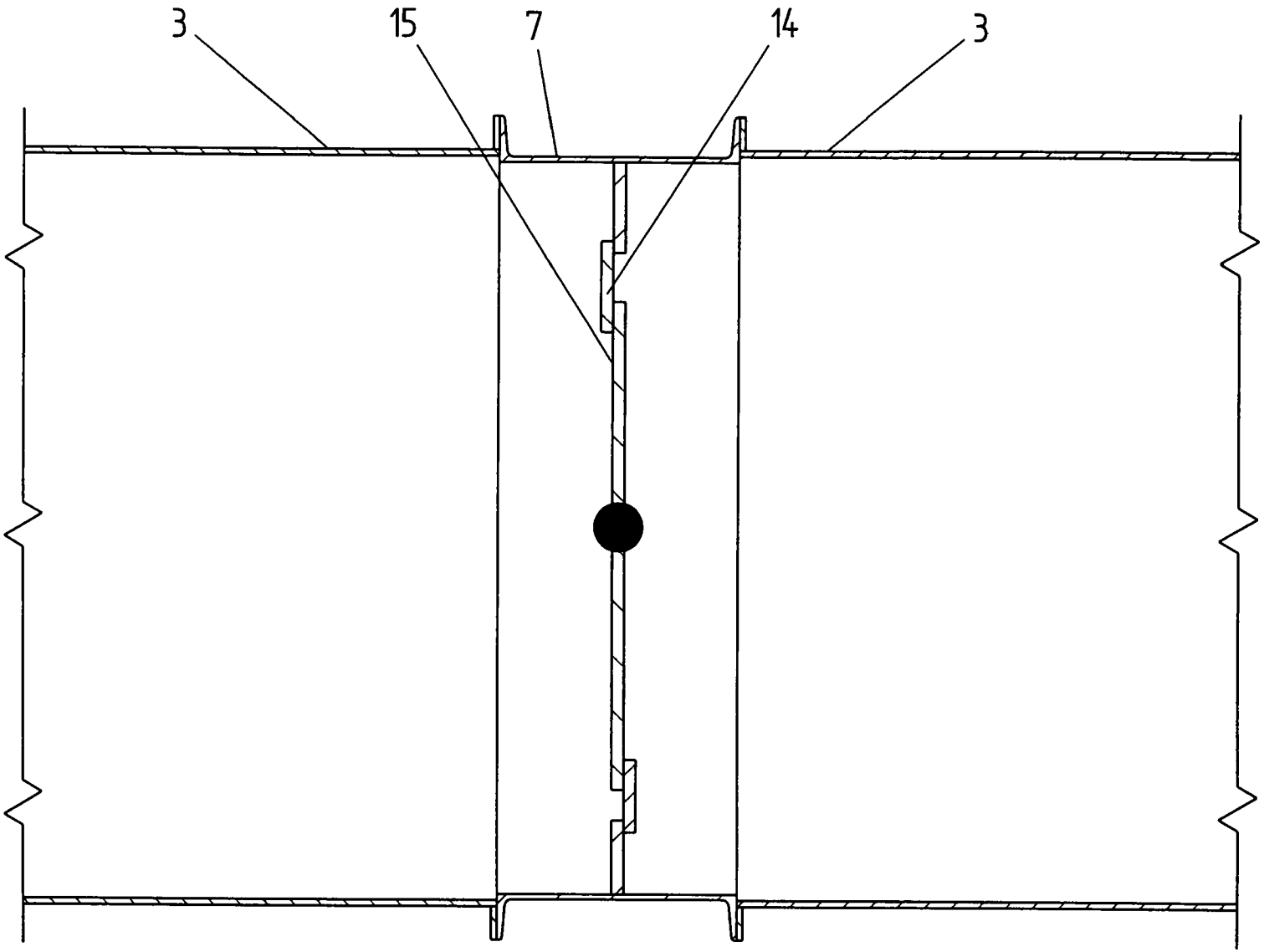
FIG. 5 is an enlarged schematic view of the first flow control butterfly valve of FIG. 1 in the closed position, illustrating the sealing strip interacting with the butterfly valve.

FIG. 2 shows an arrangement of a quick-acting slide valve 23 downstream of the coal pulverizer 1 as seen in the direction of flow of the primary air flow, i.e., in the coal dust line 18 between the coal pulverizer 1 and the coal dust burners 19 as required by the American regulation NFPA 8503, Standard for Pulverized Fuel Systems. The arrangement according to FIG. 2 is identical to the arrangement of FIG. 1 with the exception of the quick-acting slide valve 23, and the steps of the procedure described for FIG. 1 with regard to a shutting off for repair or servicing work inside the coal pulverizer 1 apply here as well. In the event of repair or servicing on a coal pulverizer 1, as was described for the arrangement according to FIG. 1, the shut-off butterfly valve 2 is closed and the pressure relief butterfly valve 9 is opened simultaneously, then the first flow control butterfly valve 7 is closed and then the second flow control butterfly valve 8 is opened. For the shut-off between the coal pulverizer 1 and the coal dust burner 19, shut-off arrangement 22, which can be actuated either manually or by means of an actuating drive 24, can then be closed. The quick-acting slide valve 23 is equipped with an actuating drive 24, which can be powered pneumatically, hydraulically or electrically. In emergency situations, the coal dust flow in the direction of the coal dust burner 19, i.e., the combustion chamber, can be cut off by the quick closing of the quick-acting slide valve 23.

In terms of the chronological order, the individual steps of the procedure take place either immediately after the preceding step of the procedure or within a time span of several seconds. The exceptions are the steps of the procedure that are performed simultaneously. The step of the procedure after the closing of the shut-off butterfly valve 2 and the simultaneous opening of the pressure relief butterfly valve 9, i.e., the closing of the first flow control butterfly valve 7, can be initiated, for example, as soon as the shut-off butterfly valve 2 has left the "open position" state and transitions into the "closed position" state. A very quick chronological progression of the two steps of the procedure is brought about by this measure. The subsequent opening of the second flow control butterfly valve 8 can be made dependent upon whether the shut-off butterfly valve 2 has already reached the "closed position". If that is the case, the cold primary air, which serves as sealing air, is conducted in the direction of the shut-off butterfly valve 2 only if the shut-off valve 2 is closed and the pressure relief butterfly valve 9 is open to divert the sealing air. The particular open and closed positions of the various shut-off arrangements or butterfly valves 2, 7, 8, 9, 22, 23 can be indicated by means of sensors, limit-stop switches, etc., not shown.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A primary air system for a combustion plant providing a flow of primary air to at least one coal pulverizer emitting pulverized coal in a downstream direction to a furnace, the primary air system comprising:

a first primary air line for feeding hot primary air to the coal pulverizer;

a second primary air line for admixing of cold primary air into the hot primary air line at a mixing location, the mixing location being disposed at a position upstream of the coal pulverizer; and a control system for shutting off the flow of primary air to the coal pulverizer, when the coal pulverizer is being repaired or serviced while the furnace is in operation, the control system including a first flow control butterfly valve disposed in the first primary air line at a position upstream of the mixing location, the first flow control butterfly valve including sealing strips, a second flow control butterfly valve disposed in the second primary air line at a position upstream of the mixing location, a shut-off butterfly valve, disposed in the primary air line intermediate the mixing location and the coal pulverizer, the shut-off butterfly valve including a tandem wing having substantially parallel, first and second wings defining a space therebetween, the tandem wing being supported at a cental location and being movable between an open position and a closed position, and sealing strips, a pressure relief line providing fluid communication with the space between the first and second wings when the tandem wing is in the closed position, and a pressure relief butterfly valve disposed in the pressure relief line.

2. The system according to claim 1 wherein the shut-off butterfly valve and the pressure relief butterfly valve each have an actuator, the control system further including a butterfly valve actuating arrangement coupling the shut-off butterfly valve actuator to the pressure relief butterfly valve actuator.

3. The system according to claim 1 wherein the shut-off butterfly valve tandem wing is disposed in a housing and the sealing strips of the shut-off butterfly valve are located either on the tandem wing or on the housing.

4. The system according to claim 1 wherein the first flow control butterfly valve also includes a butterfly valve wing disposed within a housing, and the sealing strips of the first flow control butterfly valve are located either on the butterfly valve wing or on the housing.

5. The system according to claim 1 wherein the primary air system also comprises a coal dust line disposed downstream of the coal pulverizer and providing communication with the coal pulverizer, the control system further including a shut-off arrangement.

6. The system according to claim 1 wherein the shut-off butterfly valve is a safety quick-acting butterfly valve.

7. The system according to claim 1 wherein the primary air system also comprises a coal dust line disposed downstream of the coal pulverizer and providing communication with the coal pulverizer, the control system further including a quick-acting slide valve.

8. Method for the operation of a system according to claim 1 comprises:

moving the shut-off butterfly valve tandem wing to the closed position, whereby the flow of primary air to the coal pulverizer that is to be serviced or repaired is shut off, and simultaneously opening the pressure relief butterfly valve, whereby a flow of leakage air is diverted from the space between the first and second wings of the tandem wing of the shut-off butterfly valve through the pressure relief line;

closing the first flow control butterfly valve and shutting off of the flow of hot primary air to the coal pulverizer; and opening the second flow control butterfly valve and feeding cold primary air through the primary air lines to the first flow control butterfly valve and the shut-off butterfly valve as sealing air.

9. Method according to claim 8 wherein after opening the second flow control butterfly valve, a shut-off arrangement downstream of the coal pulverizer is closed.

10. Method according to claim 8 wherein opening the second flow control butterfly valve is initiated only when the shut-off butterfly valve tandem wing is in the closed position.

* * * * *